United States Patent [19]

Outzen

[11] Patent Number: 4,759,693

[45] Date of Patent: Jul. 26, 1988

[54] SUCTION SOUND DAMPER

[75] Inventor: Svend E. Outzen, Sønderborg, Denmark

[73] Assignee: Danfoss A/S, Nordborg, Denmark

[21] Appl. No.: 66,603

[22] Filed: Jun. 26, 1987

[30] Foreign Application Priority Data

Jul. 9, 1986 [DE] Fed. Rep. of Germany ..... 3622996

[51] Int. Cl.[4] ..... F04B 39/00

[52] U.S. Cl. ..... 417/312; 417/540; 181/272; 181/403; 62/293

[58] Field of Search ..... 417/540, 541, 542, 312; 418/DIG. 1; 181/272, 229, 403; 220/4 B, 4 E; 62/293

[56] References Cited

U.S. PATENT DOCUMENTS

| | | | |
|---|---|---|---|
| 4,109,751 | 8/1978 | Kabele | 181/272 X |
| 4,370,104 | 1/1983 | Nelson et al. | 417/312 |
| 4,449,610 | 5/1984 | Bar | 181/272 X |
| 4,450,933 | 5/1984 | Fukuoka et al. | 181/229 |
| 4,531,894 | 7/1985 | Kawai et al. | 417/312 |
| 4,573,880 | 3/1986 | Hirano et al. | 181/403 X |
| 4,582,468 | 4/1986 | Bar | 181/403 X |

FOREIGN PATENT DOCUMENTS

| | | | |
|---|---|---|---|
| 58-160570 | 9/1983 | Japan | 417/312 |

*Primary Examiner*—Leonard E. Smith
*Assistant Examiner*—Eugene L. Szczecina, Jr.
*Attorney, Agent, or Firm*—Wayne B. Easton

[57] ABSTRACT

A suction sound damper for a slide piston refrigerant compressor that includes a suction nipple that is pushable into a groove of a cylinder cover of the compressor when the nipple is in a predetermined position, and is seatable in sockets formed in two shells of a damper housing. The shells are sealed together after the nipple is seated in the sockets. The suction nipple is of a material having a higher thermal resistance than the shell material. The damper includes intermediate walls that together with the shells form four somewhat triangular chambers with a throttle opening from the first chamber to the second chamber, an elongated throttle passage from the second chamber to third chamber and a throttle opening from the third chamber to the fourth chamber. The suction nipple opens to the first chamber and each shell includes a part of an inlet that opens to the fourth chamber.

21 Claims, 4 Drawing Sheets

SUCTION SOUND DAMPER

Figure 1:
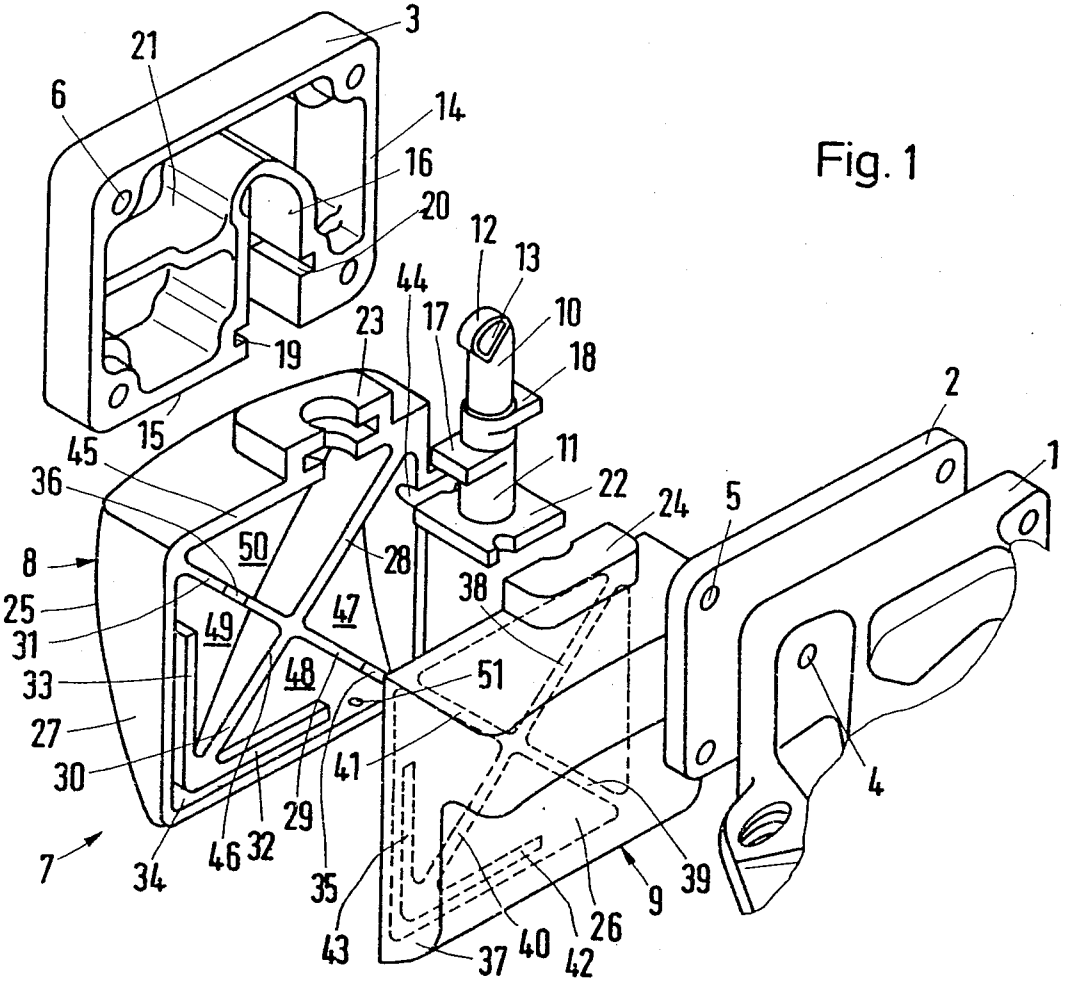

The invention relates to a suction sound damper for a slide piston refrigerant compressor, comprising a plastics housing which consists of two shells interconnected, preferably welded, at their rims, is connected to the cylinder cover of the compressor by way of a suction nipple, and has at least two chambers connected by way of a throttle point.

In a known suction sound damper of this kind (DE-OS No. 32 06 038), the plastics housing consists of two identical shells from each base of which there extends an integral nipple. One nipple forms an inlet nipple and the other a suction nipple. The second nipple is closed at one end. It serves to secure the suction sound damper in the cylinder cover against rotation. With the usual dimensions inside the capsule for a hermetically encapsulated refrigerator, only little space is available perpendicular to the plane formed by the nipples. The separating gap is therefore located in the region of a smaller cross-section of the housing at a spacing from the nipples.

By using plastics, one obtains good thermal insulation so that the suction gas undergoes no undesired heating and the compressor has a good efficiency. Also, plastics has good acoustic insulating properties. The known suction sound damper must, however, be made of a material which not only withstands refrigerant but also has a high temperature resistance because it makes direct contact with the cylinder cover which can assume high temperatures. Such plastics materials are expensive. In addition, the housing is weak, especially if the volume of the housing is designed to have optimum damping characteristics against sound. One must therefore have comparatively thick walls and use comparatively much material. This likewise makes the sound damper expensive.

It is already known (DE-OS No. 32 15 586) to provide a two-part plastics sound damper with two suction tubes of metal which can then be pushed into the cylinder cover. Abutment rings and clamping rings are necessary to secure the suction tubes in a wall of the sound damper. The attachment must be complete before the two housing parts are interconnected. These suction tubes are resistant to temperature. However, they call for additional securing operations before the sound damper is assembled.

The invention is based on the problem of providing a suction sound damper of the aforementioned kind which has a plastics housing and which can be made more economically with the same or better sound damping properties.

This problem is solved according to the invention in that the suction nipple is made of a material having a higher thermal resistance than the shell material, passes through the connecting gap of the shells and is retained between the shells.

In this construction, the housing can be made of a plastics which is resistant to refrigerant and has a lower thermal resistance. Such materials are cheaper. The attachment of the suction nipple to the housing does not require a separate operation. Instead, this attachment is brought about as the shells are interconnected. The suction nipple can in this way be retained securely. This manner of assembly likewise saves costs.

Advantageously, the suction nipple has a projecting retaining element which engages in fittings of both shells. This secures the suction nipple against axial displacement. In conjunction with the depressions, the retaining element forms a kind of labyrinth seal so that a leakage flow is practically suppressed even if the suction nipple is not closely surrounded by the shell material.

It is favourable for the retaining element and the fittings to be unsymetrical longitudinally of and/or transversely to the connecting gap to define a predetermined position of installation. The suction nipple is then secured to the sound damper against rotation. If the suction nipple is built in at a defined position, the sound damper will likewise have the correct position.

Very accurate positioning of the suction nipples and sound damper can be achieved in that the cylinder cover is provided at the end face facing the cylinder with a groove which extends from one side wall and receives the suction nipple, and that the suction nipple comprises two opposed projections which engage in complementary guides of the wall of the groove.

If the projections and guides are unsymetrical and preferably axially off-set, incorrect installation can be prevented.

With particular advantage, the suction nipple is moulded from plastics material. This plastics must have a higher thermal resistance than the plastics of the housing so that the two materials will not fuse into each other. However, this is insignificant because the suction nipple is clampled between the shells. Production from plastics materials also permits the selection of any desired shape and in particular to make the retaining element and the projections integral.

According to a second solution, which can be used in conjunction with the first solution, provision is made for the shells to be flat and to be interconnected in the region of the largest cross-section of the housing and for the connection of the shells to take place not only at the rim but also at least at a part of the intermediate walls.

'Flat' shells are those with a depth less than their width or length. The connecting groove running around the rim provides a comparatively large frame of high strength. The suction nipple can be tightly seated here. The adjoining side walls are likewise very strong because they have a shallower height. The bases of the shells are strengthened not only in that they are stiffened by intermediate walls but also in that intermediate walls of both shells are interconnected. Despite the large areas of the bases of the shells, one therefore obtains a strong housing which can be made without excessively thick walls. The sound damper is therefore economical. By selecting the largest cross-section of the housing and arranging the intermediate walls, the number and volume of the chambers can be selected at will so that optimum sound damping properties can be achieved. All this is possible without requiring deep shells which would increase the mould costs.

To form a throttle point between adjacent chambers, at least one intermediate wall may have a recess at the end. The size of the recess determines the throttle resistance.

Another possibility is to have at least one intermediate wall extending adjacent to another wall between adjacent chambers in order to form a throttle passage. Such a throttle passage can be quite long so that larger throttling resistances can be achieved without excessively small cross-sections.

It is particularly favourable for the shells to be substantially rectangular and intermediate walls to extend from the region of the centres of the bases of the shells to the side walls in the region of the corners. Such a suction sound damper can be accommodated in the capsule to save space and has an extraordinary strength which ensures that resonance oscillations of the housing do not occur at all or lie above the hearing threshold.

The flat shape of the shells also permit each shell to be made in one piece with one half of an inlet nipple. Suction gas is therefore directed into the interior of the inlet chamber and there strikes an intermediate wall so that any oil contained in the refrigerant is separated.

In a preferred embodiment, four substantially triangular chambers in cross-section are connected in series by way of throttle points, the fourth chamber which is provided with the inlet being arranged at the side of the housing, the third and fourth chamber which is provided with an oil outlet aperture is arranged in the lower part of the housing and the fourth chamber which is provided with the suction nipple is arranged in the upper part of the housing. Such a sound damper has a remarkably high degree of damping in the audible range. The oil separated in the first and second chambers can run off downwardly. The connection of the suction nipple at the top is not impeded.

The oil outlet aperture can be provided with a small tube. The sound damping effect can then not be impeded by the aperture.

It is also favourable for the bases of the shells and the intermediate walls to be designed so that substantially no parallel wall surfaces are opposite one another in the chambers. This prevents the formation of resonance oscillations in the interior of the housing. This condition is fulfilled by the intermediate walls if they are oblique with respect to the side walls so as to form substantially triangular chambers. For the bases of the shells, the condition is for example achieved in that the one base of the shell is substantially planar and the other shell base is curved twice.

With particular advantage, the shells are welded ultrasonically This provides a sealed and particularly strong connection between the two shells.

With shells to be welded in this manner, it is advisable for the interconnected intermediate walls to be provided with depressions which extend from the outside of the shells and serve to introduce a welding tool. In this way, the welding tools can be brought to the vicinity of the connecting seam so that the ultrasonic energy required for welding can be supplied with a low input power.

Advantages are also obtained if the connections at the intermediate walls are also at least partially additionally formed as tongue and groove connections by which the shells can be aligned in the region of the weld seam at the rim. By means of the interaction between the tongue and groove, one obtains a particularly good seal in the interior of the housing where it is later impossible to make a visual check. The parts to be welded together at the rim have the correct relative position at the outset without requiring a tongue and groove joint here as well.

With ultrasonic welding, it is advisable for unconnected intermediate walls to adjoin the side wall next to the corner of the shell at a slight spacing. In this way, an accumulation of materials at the corners is avoided so that the welding energy will also here suffice to soften the material.

Figure 2:
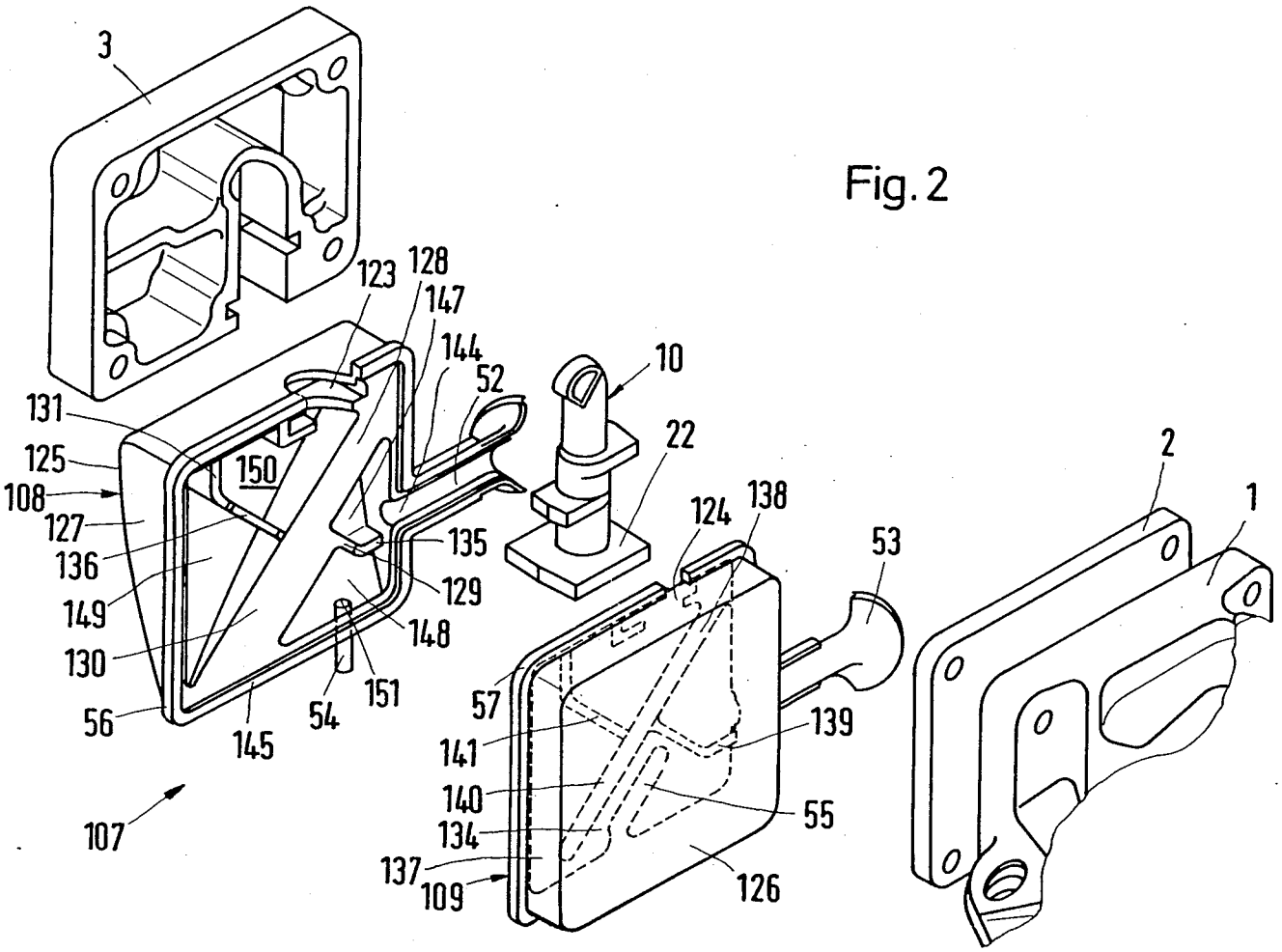
Figure 3:
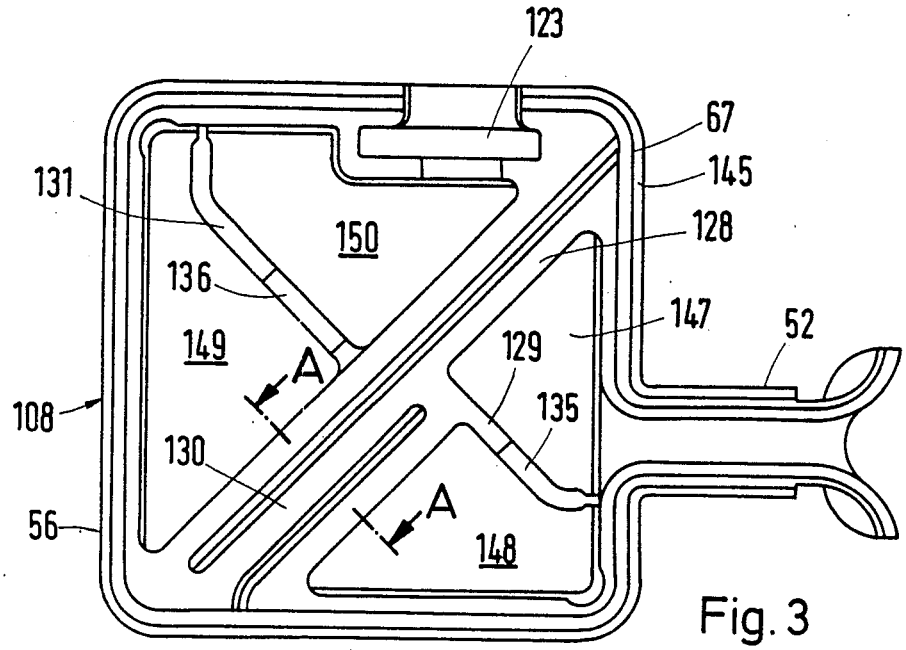
Figure 4:
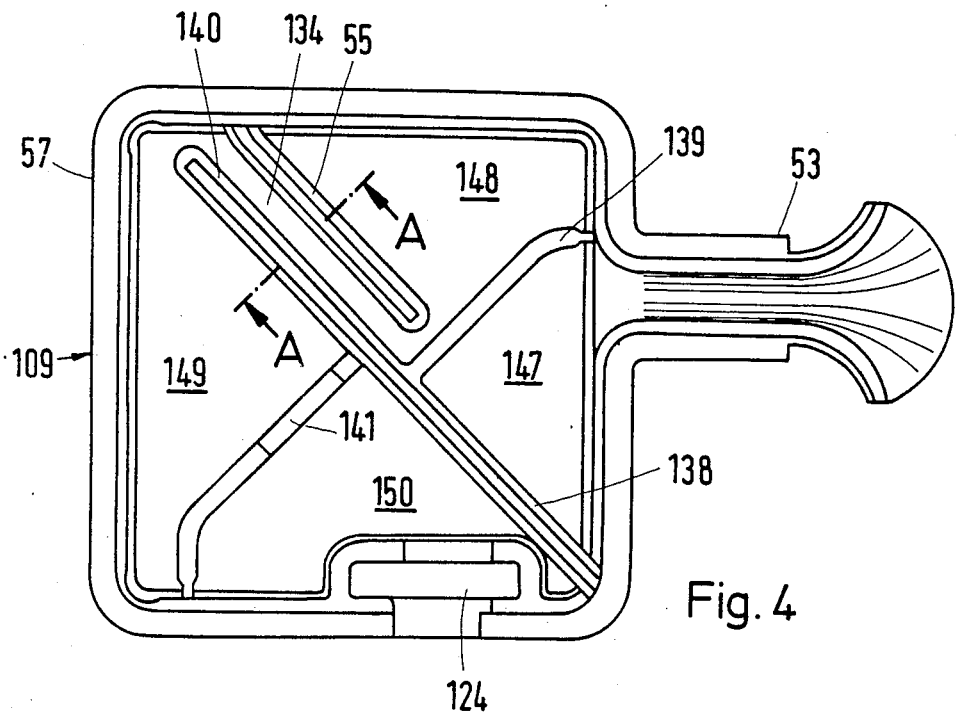
Figure 5:
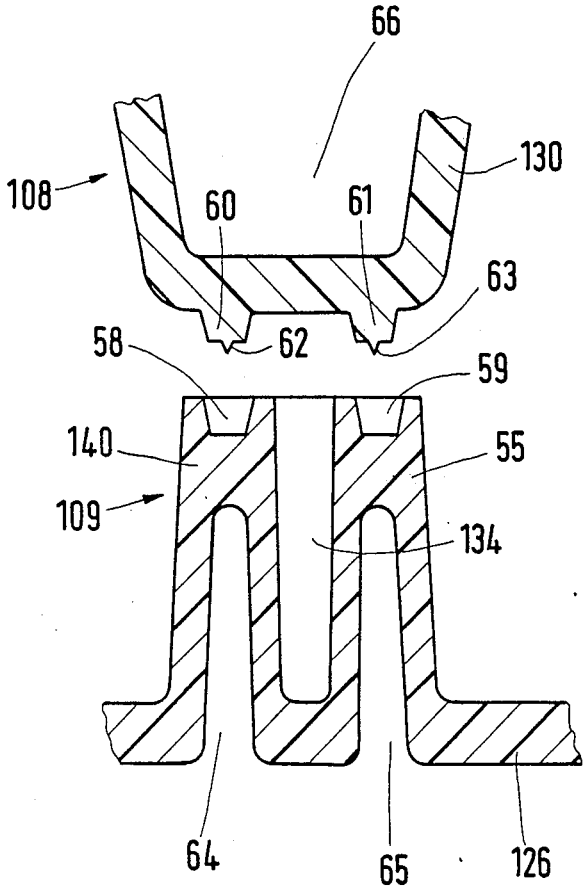

Preferred examples of the invention will now be described in more detail with reference to the drawing, wherein:

FIG. 1 illustrates parts of a suction sound damper according to the invention in conjunction with the head portion of a cylinder arrangement, FIG. 2. shows a modified embodiment similar to FIG. 1, FIG. 3 is an elevation from the interior onto the left hand shell of the suction sound damper according to FIG. 2, FIG. 4 is an elevation from the inside onto the right hand shell of the suction sound damper according to FIG. 2, and FIG. 5 is a section on the line 5—5 when assembling the two shells.

FIG. 1 shows a cylinder block 1 of a slide piston compressor of a hermetically encapsulated small refrigerator. A valve plate 2 is provided at its end face and above it a cylinder cover in that appropriate screws are passed through the screw holes 4, 5 and 6. A suction sound damper comprises a housing 7, consisting of two flat shells 8 and 9 and unified by a suction nipple 10.

The suction nipple consists of a tube 11 of which the outlet end 12 is curved so that the outlet aperture 13 can lie against the valve plate 2 in the region of the suction valve orifice (not shown). For this purpose, the cylinder cover 3 is provided at its end face 14 facing the cylinder with a groove 16 which extends from the side wall 15 and into which the suction nipple 10 can be pushed. Its tube 11 carries at opposed sides two axially offset projections 17 and 18 which can engage in complementary guides 19 and 20 in the wall of the groove 16. The rest of the interior of the cylinder cover 3 serves as a pressure valve chamber 21. The suction nipple 10 is moulded from a refrigerant-resistant plastics of elevated thermal resistance. When it has been pushed into the groove 16 and the cylinder cover 3 secured to the cylinder block 1, the suction nipple 10 has an accurately defined position.

At the inlet end, the suction nipple 10 has a plate-shaped retaining element 22 adapted to engage in an emplacement 23 of the shell 8 and in an emplacement 24 of the shell 9. Upon assembly of the two shells 8 and 9, the suction tube 11 is therefore clamped tight and held securely. The retaining element 22 is unsymetrical. It projects further towards the shell 8 than it does toward the shell 7. This accurately predetermines the position in the sound damper housing 7. The suction sound damper can be carried in the correct position by the cylinder cover 3 solely by way of the suction nipple.

The two shells 8 and 9 have a substantially square cross-section of largest area. The length and width are considerably greater than the depth. The shell 8 has a doubly curved base 25 and the shell 9 has a planar base 26 provided with a step. The shell 8 has a peripheral side wall 27 and four intermediate walls 28, 29, 30 and 31 which extend from the base 25 of the shell and in each case from the middle of the shell base towards the corners. The intermediate walls 28, 29 and 30 are connected to the side walls 27 at the corners and the intermediate wall 30 terminates shortly in front of the corner where it is connected to additional intermediate walls 32 and 33 which extend parallel to sections of the peripheral side wall 27. The additional intermediate walls 32 and 33 together with the side wall 27 therefore bound a throttle passage 34 of considerable length. In the ends of the intermediate walls 29 and 31 there are depressions 35 and 36 which form throttle points in the assembled condition. The shell 9 has corresponding side walls 37, intermediate walls 38 to 41 and additional intermediate walls 42 and 43. An inlet 44 is also provided, which adjoins an inlet nipple clearly shown in FIG. 2.

The two shells 8 and 9 are of a plastics material which is resistant to refrigerant and has a low thermal resistance. During assembly, they are pushed together with the suction nipple 10 built in and they are interconnected not only at the end face 45 near the rim but also the end face 46 of at least part of the intermediate walls. The connection can for example be by way of adhesion (after applying a solvent or heating) or in any other known manner.

This creates four chambers 47 to 50 in the interior of the suction sound damper. The inlet chamber 47 is connected to the inlet 44. By way of the throttle point 35, it communicates with the underlying third chamber 48. From there, the throttle passage 34 leads to the second chamber 49. The latter is connected to the uppermost chamber 50 by way of the throttle point 36. From it, the suction nipple 10 leads to the cylinder block. With suitable dimensioning of the chamber volume and the throttle resistances, one obtains extraordinarily good damping of sound in the audible range. The throttle points 35 and 36 bring about less throttling and the throttle passage 34 more intensive throttling. Since the chambers have a triangular cross-section and the bases of the shells have no wall sections that are parallel to one another, no prolonged resonance oscillations can be created in the chambers.

An oil outlet orifice 51 is provided in the third chamber 48. When refrigerant enters through the inlet 44, the intermediate walls 28 and 38 serve as baffle plates at which any oil that was carried along can be separated. This can reach the third chamber 48 through the throttle point 35 and then be led off.

In the embodiment of FIGS. 2 to 5, the construction of the cylinder block 1, valve plate 2, cylinder cover 3 and suction nipple 10 remains unchanged. The shells are so modified that they can be interconnected by ultrasonic welding. Corresponding parts are provided with reference numerals increased by 100. The base 125 of the shell 108 is again doubly curved. The base 126 of the shell 109 is planar throughout. Each shell is made in one piece with one half 52 or 53 of an inlet nipple. The emplacements 123 and 124 for receiving the retaining element 22 of the nipple 10 are placed in the interior of the side walls 127 and 137. A small tube 54 is pushed into the oil outlet orifice 151. The throttle passage 134 is in this case formed by the intermediate wall 140 and an additional intermediate wall 55 parallel thereto, both intermediate walls co-operating with the widened intermediate wall 130.

To enable the two shells 108 and 109 to be interconnected by ultrasonic welding, the end face 145 at the rim is located at an outwardly projecting rim 56 or 57 so that the welding tools can be brought close to the weld seam. The intermediate walls 129, 131, 139 and 141 which in this case simply lie on top of each other without being welded together, extend from the middle of the bases of the shells and are directed towards the corners but adjoin the peripheral side wall 127 or 137 at a slight spacing from the corner to avoid the accumulation of material at the corner that might impede the welding process. The formation of the weld seams at the intermediate walls 128, 130, 138 and 140 as well as at the additional intermediate wall 55 is clearer from FIGS. 3 to 5.

In the region of the weld seam to be formed, the intermediate wall 40 has a groove 58 and the additional intermediate wall 55 has a groove 59. The grooves have inclined side walls. Accordingly, the wider intermediate wall 130 has two projecting tongues 60 and 61 provided at the front end with a fine fin-like rib 62 or 63. For introducing the welding tool, two depressions 64 and 65 in the shell 109 lead up to the vicinity of the grooves 58 and 59. In the intermediate wall 130 there is a wider depression 66 for the same purpose. A fin-like rib 67 corresponding to the ribs 62 and 63 is provided on the end face 145 adjacent the rim but without the construction of a tongue and groove.

For assembly, the two shells 108 and 109 with the introduction of the retaining element 22 in the emplacements 123 and 124 are pushed together until the ribs 60 and 61 engage in the grooves 58 and 59. This accurately aligns the two shells with respect to each other. The ultrasonic welding tools are then brought from both sides to the rims 56 and 57 or into the depressions 64 to 66. If, now, ultrasonic energy is delivered under pressure the material will melt at the ribs 62, 63 and 67 until the tongues 60 and 61 are completely within the grooves 58 and 69. During this time, liquified plastics has spread sideways and brought about sealed and secure adhesion. The thus completed suction sound damper is mounted on the cylinder block 1 by introducing the suction nipple 10 in the cylinder cover 3 and securing it to the cylinder block 1.

In one example, the two shells 8 and 9 consisted of polybutylene terephtalate (PBTP) marketed by the name Crastin SK 603 and the suction nipple 10 consisted of a polyphenylene sulphide (PPS) marketed as Halar 500.

I claim:

1. A suction sound damper for a slide piston refrigerant compressor that includes a compressor suction nipple opening, comprising a plastic housing that includes a first and a second shell that each has a peripheral rim joined to the rim of the other shell, means joined to the shells to provide at least a first and a second chamber within the shells and a throttle opening that fluidly connects the first chamber to the second chamber, and a suction nipple clampingly retained by the shells to extend therebetween, opening to one of the chambers and being adapted to extend into the compressor opening, the suction nipple being made of plastic a material having a higher thermal resistance than the shell material.

2. A suction sound damper according to claim 1, characterized in that the suction nipple includes a retaining element, the retaining element having at least two parts, and that each of the shells includes a socket portion for receiving the respective retaining element part.

3. A suction sound damper according to claim 1, characterized in that each shell is of a greater length and height than its depth and includes a base, that the means joined to the respective shell includes intermediate wall portions joined to the respective shell base to extend toward the base of the other shell, and that each shell intermediate wall portions include a wall part joined to the wall part of the other shell.

4. A suction sound damper according to claim 3, characterized in that each shell is made of a single piece and includes one half of an inlet nipple that opens to a chamber other than the one the suction nipple opens to.

5. A suction sound damper according to claim 3, characterized in that at least one of the wall portions includes a wall that at least in part defines a throttle opening.

6. A slide piston refrigerant compressor having a valve plate and a cylinder cover secured to the valve plate that includes wall means defining an axially elongated suction nipple groove and axially spaced first and second guide grooves opening to the nipple groove and a suction sound damper that includes an axially elongated, refrigerant resistant plastic suction nipple that is pushably extended into said suction nipple groove and includes a tube, a first and a second axially spaced projection joined to said tube and extended into the guide grooves, a plate shaped retainer element joined to the suction nipple, a first and a second shell having peripheral edges joined together to form a sound damper housing, each shell having a socket opening adjacent to its peripheral edge, the sockets and retainer plate being of relative shapes to have the retainer plate extended into the sockets and to hold the suction nipple in a predetermined position relative to the housing when the shells are joined together and intermediate wall means joined to the shells to in conjunction with the shells form at least a first and a second chamber and a throttle opening for placing the first chamber in fluid communication with the second chamber, the suction nipple opening to the first chamber and an elongated wall portion that in conjunction with one of the intermediate wall means and one of the side walls at least in part forms throttle passage that opens to the second chamber.

7. The apparatus of claim 6 further characterized in that the guide grooves are unsymetrical and the projections are unsymetrical.

8. The apparatus of claim 7 further characterized in that each shell has a base and peripheral side walls joined to the base, the side walls having the peripheral edges, each of the sockets being joined to the respective shell side wall.

9. The apparatus of claim 8 further characterized in that one of the side walls of each of the shells has an inlet portion remote from the sockets and that the intermediate wall means of each of the shells has a wall portion joined to an intermediate wall portion of the other.

10. The apparatus of claim 8 further characterized in that the intermediate wall means includes means that in conjunction with the side walls and bases form a third chamber, the throttle passage being elongated and opening to the third chamber.

11. The apparatus of claim 8 further characterized in that each of the bases has a central portion and that the intermediate wall means includes means that in conjunction with the bases and side walls form a third chamber, that the throttle passage is elongated and places the second chamber in fluid communication with the third chamber, that the intermediate wall portion is joined to at least one of the bases, extends from the base central portion toward a shell side wall and terminates in spaced relationship to the side walls and that the intermediate side wall means includes a second elongated wall portion that extends from one of the sidewalls toward the base central portion and is spaced from the throttle passage.

12. The apparatus of claim 8, further characterized in that each of the bases has a central portion and that the intermediate wall means includes means that in conjunction with the bases and side walls forms a third chamber, that the throttle passage is elongated and places the second chamber in fluid communication with the third chamber, that the intermediate wall means includes a second intermediate wall portion joined to at least one of the bases, extends from the base central portions toward the shell side walls and terminates in spaced relationship from the side walls and that the first intermediate portion extends from the second intermediate wall portion and along at least one of the side wall portions to in conjunction therewith at least in part form the throttle passage.

13. The apparatus of claim 8 further characterized in that each of the shells is of generally rectangular box-shaped configuration, that each base has a central portion, that the intermediate wall means in conjunction with the side wall portions and the bases also define a third and a fourth chamber and a second throttle passage placing the third chamber in fluid communication with the fourth chamber, that the first throttle passages places the third chamber in fluid communication with the second chamber, that the intermediate wall means includes a first, a second, a third and a fourth wall joined to the respective base and extends from the base central portions toward at least one of the side walls of the respective shell to respectively at least in part separate the first chamber from the fourth chamber, the second chamber from the first chamber, the third chamber from the second chamber and the fourth chamber from the third chamber.

14. The apparatus of claim 8 further characterized in that each shell is of a greater length and width than its depth, and made of plastic material, the shells being welded together with the suction nipple positioned in the sockets, the suction nipple being made of a material having a higher thermal resistance than the shell material.

15. A suction sound damper for a slide piston refrigerant compressor that includes a compressor suction nipple opening, comprising a plastic housing that includes a first and a second shell that each has a peripheral rim joined to the rim of the other shell, means joined to the shells to provide at least a first and a second chamber within the shells and a throttle opening that fluidly connects the first chamber to the second chamber, and a suction nipple retained by the shells to extend therebetween, opening to one of the chambers and being adapted to extend into the compressor opening, the suction nipple being made of a material having a higher thermal resistance than the shell material, the suction nipple including a retainer element having at least two parts, and each of the shells including a socket portion for receiving the respective retainer element part.

16. A suction sound damper according to claim 15, characterized in that the socket portions are unsymetrical and that the retainer element is of an unsymetrical shape so that the retainer element can extend into the socket portions in only a predtermined installation position.

17. A suction sound damper according to claim 15, characterized in that the intermediate wall portions of each shell also divides the respective shell into a third and a fourth chamber, that each chamber is substantially triangular in transverse cross section, that the side walls are provided with an inlet opening to the fourth chamber, that the intermediate wall portions include a throttle passage fluidly connecting the second chamber to the third chamber and a throttle opening fluidly connecting the third chamber to the fourth chamber and that the suction nipple opens to the first chamber.

18. A suction sound damper according to claim 17, characterized in that the housing has an upper part and a lower part, that the first chamber is located in the upper part of the housing, that the third chamber is located in the lower part of the housing and that at least one of the shells has a drain located in the lower part of the housing and opening to the third chamber.

19. A suction sound damper according to claim 17, characterized in that each chamber is in part formed by a side wall and two intermediate wall portions that over the major portions of their lengths extend in non-parallel relationship to one another and to the respective side wall.

20. A suction sound damper according to claim 17, characterized in that intermediate wall portions of one shell have grooves, that the intermediate wall portions of the other shell have tongue portions extended into said groove portions, and that the third chamber is in part formed by two side wall, and that the side walls of one shell are joined to the side walls of the other shell by a weld seam.

21. A suction sound damper for a slide piston refrigerant compressor that includes a compressor suction nipple opening, comprising a plastic housing that includes a first and a second shell that each has a peripheral rim joined to the rim of the other shell, a base and side walls joined to the base and to one another to form four corners, each shell being generally rectangular and being of a greater length and height than its depth, means joined to the shells to provide at least a first and a second chamber within the shells and a throttle opening that fluidly connects the first chamber to the second chamber, said means including intermediate wall portions joined to the respective shell base to extend toward the base of the other shell, each shell intermediate wall portions including a wall part joined to the wall part of the other shell, the intermediate wall portions of each shell at least initially extending from near the center of the base toward the base corners, and a suction nipple retained by the shells to extend therebetween, opening to one of the chambers and being adapted to extend into the compressor opening, the suction nipple being made of a material having a higher thermal resistance than the shell material.

* * * * *